US011745070B2

(12) United States Patent
Wu

(10) Patent No.: US 11,745,070 B2
(45) Date of Patent: Sep. 5, 2023

(54) BASKETBALL GOAL ASSEMBLY WITH RETURN CHUTE

(71) Applicant: Medal Sports (Taiwan) Corporation, Taipei (TW)

(72) Inventor: Shih Hsia Wu, Shenzhen (CN)

(73) Assignee: MEDAL SPORTS (TAIWAN) CORPORATION, Taipei (TW)

( * ) Notice: Subject to any disclaimer, the term of this patent is extended or adjusted under 35 U.S.C. 154(b) by 0 days.

(21) Appl. No.: 17/481,685

(22) Filed: Sep. 22, 2021

(65) Prior Publication Data

US 2022/0088451 A1 Mar. 24, 2022

Related U.S. Application Data

(60) Provisional application No. 63/082,355, filed on Sep. 23, 2020.

(51) Int. Cl.

| | |
|---|---|
| ***A63B 63/08*** | (2006.01) |
| ***A63B 69/00*** | (2006.01) |
| *A63B 63/00* | (2006.01) |

(52) U.S. Cl.

CPC ..... *A63B 63/08* (2013.01); *A63B 63/083* (2013.01); *A63B 69/0071* (2013.01); *A63B 2063/001* (2013.01)

(58) Field of Classification Search

CPC ..... A63B 63/083; A63B 2063/001; A63B 69/0071

See application file for complete search history.

(56) References Cited

U.S. PATENT DOCUMENTS

| | | | | |
|---|---|---|---|---|
| 3,814,421 | A * | 6/1974 | Spier, Jr. | A63B 69/0071 473/433 |
| 3,945,638 | A | 3/1976 | Luebkeman | |
| 4,786,052 | A * | 11/1988 | Zinger | A63B 63/083 473/433 |
| 4,896,882 | A | 1/1990 | Coleman | |
| 4,957,289 | A | 9/1990 | Kotlarz | |
| 5,141,224 | A * | 8/1992 | Nolde | A63B 69/0071 473/435 |
| 5,224,699 | A * | 7/1993 | Zaruba | A63B 63/083 273/375 |
| 5,333,853 | A * | 8/1994 | Hektor | A63B 63/083 473/433 |
| 5,348,290 | A | 9/1994 | Matherne et al. | |
| 5,779,569 | A | 7/1998 | Townsend et al. | |

(Continued)

*Primary Examiner* — Laura Davison
(74) *Attorney, Agent, or Firm* — Dickinson Wright PLLC

(57) ABSTRACT

A basketball return chute assembly includes a chute and a backboard attachment device. The chute is adapted to receive a ball from a basketball basket assembly attached to a backboard and direct the received ball back to a game player. The backboard attachment device is connected to the chute and is adapted to attach to the backboard, to place the chute beneath the basket assembly, and to cause the chute to direct the received ball in a direction away from the backboard. The backboard attachment device is connected to the chute via a hinge. The chute includes a slide with a knuckle at one end and the backboard attachment device includes a plate with another knuckle at one end. The slide is one leaf of the hinge, and the plate is the other leaf of the hinge. The hinge is held together using a pin inserted through the knuckles.

9 Claims, 10 Drawing Sheets

(56) References Cited

U.S. PATENT DOCUMENTS

| | | | | |
|---|---|---|---|---|
| 7,008,337 | B2 | 3/2006 | Kershaw | |
| 7,201,676 | B2 * | 4/2007 | Rumfola, III | A63B 69/0071 473/448 |
| 7,530,909 | B2 | 5/2009 | Thomas et al. | |
| 8,387,934 | B2 | 3/2013 | Nally et al. | |
| 10,843,055 | B2 * | 11/2020 | Barnes | A63B 63/083 |
| 2016/0287964 | A1 * | 10/2016 | Jones | A63B 63/083 |

* cited by examiner

BASKETBALL GOAL ASSEMBLY WITH RETURN CHUTE

CROSS-REFERENCE TO RELATED APPLICATION

This U.S. Non-Provisional Patent Application claims the benefit of and priority to U.S. Provisional Patent Application Ser. No. 63/082,355 filed on Sep. 23, 2020, titled "Two Player Door Court," the entire disclosure of which is hereby incorporated by reference.

BACKGROUND OF THE INVENTION

1. Field of the Invention

The disclosure herein relates to athletic equipment for sports wherein one of the primary objectives is throwing a ball through a hollow target or goal, such as a hoop in the game of basketball. More specifically, some embodiments of the disclosure include a chute assembly for returning a ball after the ball has passed through the hoop. The chute assembly is adapted to be attached to a backboard rather than the hoop or a basket assembly, which eases installation and improves stability over previous designs. In addition, some embodiments of the disclosure include a goal assembly including a basket assembly, a backboard, and a ball return chute assembly adapted to be attached to the backboard rather than the basket assembly. Still further embodiments include a portable goal assembly for hanging over a door. The portable goal assembly includes a backboard, two side-by-side basket assemblies, and two ball return chute assemblies, one beneath each basket assembly, that each attaches to the backboard rather than a basket assembly.

2. Related Art

Basketball is a favorite pastime of both young and old. The first rudimentary version of basketball was played in the 1800's and, since then, has progressively become a mainstay of popular international culture. This ever increasing popularity has resulted in numerous commercial opportunities, which in turn have resulted in considerable development of the sport. For example, U.S. Pat. No. 5,779,569 (hereafter the "'569 Patent"), discloses games such as basketball that entail repetitive practice in shooting the ball through the basket. Different game situations must be practiced for a player to become adept at all phases of the game. In typical practice sessions, one or more players will attempt shots to the basket from different locations.

A frequently occurring problem during shooting practice is that after each shot, the ball must be retrieved for the subsequent shot. In particular, when a shot successfully passes through the basket, the ball tends to avoid returning to the shooter. While this is seemingly insignificant, it delays subsequent practice shooting and development. Far more practice could be completed and the overall enjoyment of practice could be improved if the ball could be retrieved expeditiously.

The prior art has suggested apparatuses for directing the return of the ball following successful shots. The ability to effect return following an unsuccessful shot is limited due to the random trajectory or rebound direction following an unsuccessful shot. However, successful shots will predictably pass through the basket, after which the ball may be intercepted and directed to return in a predetermined direction. To this end, the prior art has proposed sloping channels or chutes disposed beneath a basket. Some exemplary chutes are disclosed in U.S. Pat. Nos. 3,945,638, 4,896,882, 4,957,289, 5,348,290, and the '569 Patent. In each exemplary case, a chute is attached to a hoop or a basket assembly.

Attaching a ball return chute to the hoop or the basket assembly, however, is not easy due to the shape and construction of most basket assemblies. Also, most basket assemblies are not built to support and provide rigidity to an attached ball return chute and, as such, can degrade the structural integrity of the basket assembly over repeated usage.

As a result, additional apparatus and methods are needed to provide a ball return chute that is both easy to install and durable.

SUMMARY OF THE INVENTION

This section provides a general summary of the disclosure and is not to be interpreted as a complete and comprehensive listing of all of the objects, aspects, features and advantages associated with the present disclosure.

In accordance with one aspect of the disclosure, a basketball return chute assembly, a basketball goal assembly, and a portable two basket basketball goal assembly are disclosed.

The basketball return chute assembly includes a chute and a backboard attachment device. The chute is adapted to receive a ball from a basketball basket assembly attached to a backboard and direct the received ball back to a game player. The backboard attachment device is connected to the chute and is adapted to attach to the backboard, to place the chute beneath the basket assembly, and to cause the chute to direct the received ball in a direction away from the backboard.

In some embodiments, the chute includes a slide and the backboard attachment device includes a plate.

In some embodiments, the backboard attachment device is connected to the chute using a hinge mechanism. The chute assembly further includes a hinge pin. The slide of the chute includes a hinge chute knuckle at one end. The plate of the backboard attachment device includes a hinge plate knuckle at one end. The backboard attachment device is connected to the chute by axially aligning the hinge chute knuckle and the hinge plate knuckle and inserting the hinge pin through the hinge chute knuckle and the hinge plate knuckle while they are aligned.

In some embodiments, the hinge chute knuckle further includes a stop that fixes the position of the chute with respect to the backboard attachment device when the plate contacts the stop.

In some embodiments, the plate includes one or more holes for bolting or screwing the plate to the backboard.

In some embodiments, the plate includes one or more holes to insert one or more sensors through or to enable the one or more sensors to be spaced from and detect through.

In some embodiments, the slide includes one or more holes to reduce the weight or the amount of material required for the slide.

The basketball goal assembly includes a backboard, a basket assembly, and a basketball return chute assembly. The basket assembly is attached to the backboard. The basketball return chute assembly includes the features of the basketball return chute assembly described above.

In some embodiments, the basketball goal assembly further includes the backboard and a basket assembly attached to the backboard, wherein one or more door hangers are attached to the backboard for hanging the basketball goal assembly over a door. The basketball goal return chute assembly may include the features described above In some embodiments, each door hanger of the one or more door hangers includes a flange at one end of the door hanger to guide the door hanger over the door.

In some embodiments, the basketball return chute assembly further includes a rim hook. The rim hook is connected to the slide of the basketball return chute assembly for attaching an end of the slide to a rim of the basket assembly to stow the chute when not in use.

In some embodiments, the slide of the basketball return chute assembly further includes a clip and the rim hook includes a peg at one end. The peg is inserted into the clip to connect the rim hook to the slide.

In some embodiments, the slide of the basketball return chute assembly further includes a slot. The slot accepts the rim hook when not being used and prevents the rim hook from interfering with a ball being returned by the slide.

The portable two basket basketball goal assembly includes a backboard, one or more door hangers, two basket assemblies, and two basketball return chute assemblies. The one or more door hangers are attached to the backboard for hanging the basketball goal assembly over a door. The two basket assemblies are attached side-by-side to the backboard. Each one of the two basketball return chute assemblies may include the features of the basketball return chute assembly described above.

These and other aspects of the disclosure are set forth herein.

BRIEF DESCRIPTION OF THE DRAWINGS

The skilled artisan will understand that the drawings, described below, are for illustration purposes only. The drawings are not intended to limit the scope of the present disclosure.

Figure 1:
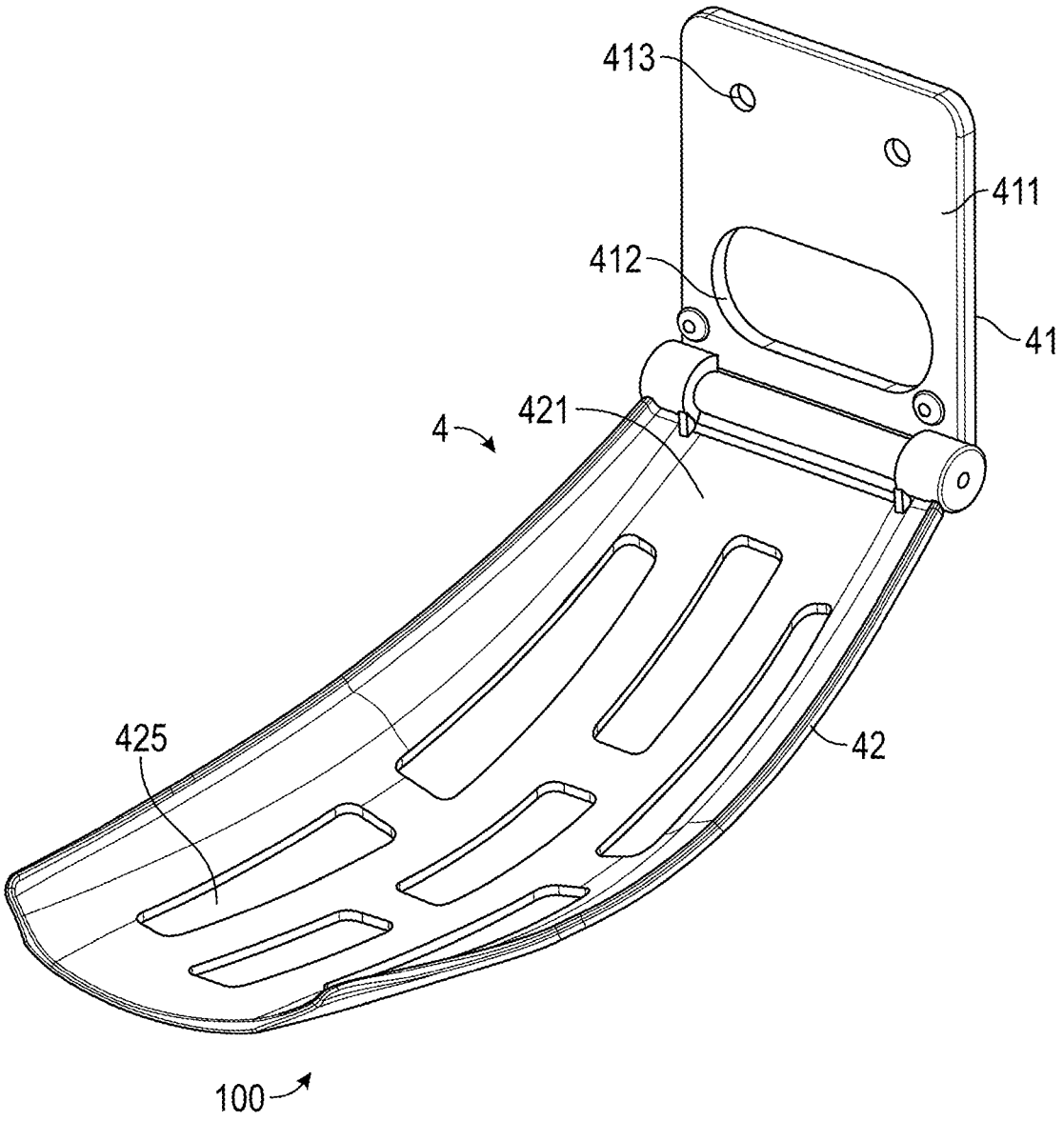
FIG. 1 is a perspective view of a front of a ball return chute assembly adapted to be attached to a backboard rather than a basket assembly, in accordance with some embodiments.

Before one or more embodiments of the present teachings are described in detail, one skilled in the art will appreciate that the present disclosure is not limited in their application to the details of construction, the arrangements of components, and the arrangement of steps set forth in the following detailed description or illustrated in the drawings. Also, it is to be understood that the phraseology and terminology used herein is for the purpose of description and should not be regarded as limiting.

DESCRIPTION OF THE ENABLING EMBODIMENT

Example embodiments will now be described more fully with reference to the accompanying drawings. In general, the subject embodiments are directed to athletic equipment for sports wherein one of the primary objectives is throwing a ball through a hollow target or goal. However, the example embodiments are only provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail. Furthermore, one skilled in the art can readily appreciate that the specific sequences in which methods are presented and performed are illustrative and it is contemplated that the sequences can be varied and remain within the spirit and scope of embodiments of the present invention.

Backboard Attached Ball Return Chute

As described above, games such as basketball entail repetitive practice in shooting the ball through the basket. A frequently occurring problem during shooting practice is that after each shot, the ball must be retrieved for the subsequent shot. The prior art has suggested apparatus for directing the return of the ball following successful shots. In each exemplary case, a chute is attached to a basket assembly or hoop.

Attaching a ball return chute to a basket assembly or hoop, however, is not easy due to the shape and varied construction of most basket assemblies. Also, most basket assemblies are not built to support and provide rigidity to an attached ball return chute.

As a result, additional apparatus and methods are needed to provide a ball return chute that is both easy to install and durable.

In some embodiments, a ball return chute assembly is adapted to be attached to a backboard rather than the basket assembly or hoop. Attaching the chute assembly to a backboard rather than the basket assembly or hoop eases installation, improves stability, and enhances the durability of the chute assembly and the entire goal assembly.

FIG. 1 is a perspective view 100 of a front of a ball return chute assembly 4. In some embodiments, the ball return chute assembly 4 may be adapted to be attached to a backboard rather than a basket assembly. The ball return chute assembly 4 includes a chute 42. The chute 42 includes sloping channel or slide 421 for catching and returning a ball to a user. In some embodiments, the slide 421 includes one or more holes 425 to reduce the weight of slide 421, the amount of material needed to construct slide 421, and prevent the slide 421 from accumulating water if used outdoors.

Ball return chute assembly 4 is adapted or constructed to be attached to a backboard rather than a basket assembly by further including a backboard attachment device 41. The backboard attachment device 41 attaches to a backboard.

The backboard attachment device 41 includes a plate 411. The plate 411 is connected to the backboard, for example, by bolting or screwing to a backboard using one or more holes 413 in the plate 411. The backboard attachment device 41 can attach to a front or back of a backboard. Thus, in some embodiments, the backboard attachment device 41 may be attached, or configured to attach, to the back of a backboard.

In some embodiments, the backboard attachment device 41 can further include one or more openings or windows 412. These openings or windows 412 can be used, for example, to enable a sensor to sense or count the number of balls received by slide 421 and perform certain actions like tallying a score.

The chute 42 may be physically connected to backboard attachment device 41 of the chute assembly 4. In some embodiments, the chute 42 is connected to the backboard attachment device 41 via a hinge mechanism that will be detailed below.

Figure 2:
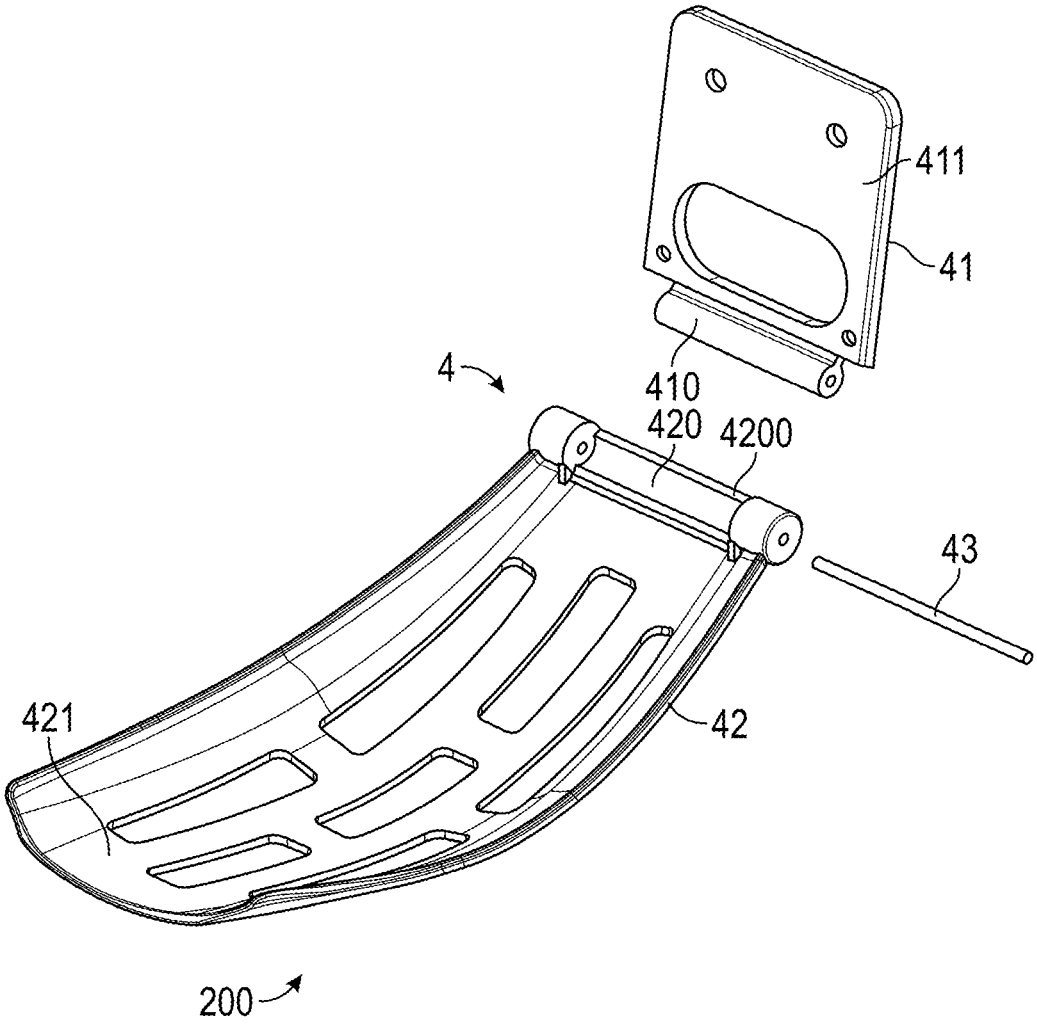
FIG. 2 is a perspective and exploded view of the front of the ball return chute assembly of FIG. 1 showing components of a hinge mechanism used to connect the chute to a backboard attachment device, in accordance with some embodiments.

FIG. 2 is a perspective and exploded view 200 of the ball return chute assembly 4 of FIG. 1 showing components of the hinge mechanism used to connect the chute 42 to the backboard attachment device 41, in accordance with some embodiments. FIG. 2 shows that the chute 42 may further include a hinge chute knuckle 420 at one end of slide 421. FIG. 2 also shows that the backboard attachment device 41 further includes a hinge plate knuckle 410 at one end of the plate 411.

In order to physically connect the chute 42 and the backboard attachment device 41 of chute assembly 4 through a hinge mechanism, the hinge chute knuckle 420 and the hinge plate knuckle 410 are axially aligned. The chute assembly 4 may further include a hinge pin 43. The hinge pin 43 is inserted through the hinge chute knuckle 420 and the hinge plate knuckle 410 when they are axially aligned to hold them in place and complete assembly of the hinge mechanism.

The chute assembly 4, therefore, may essentially be a type of a hinge. The slide 421 of the chute 42 is one leaf of the hinge, and the plate 411 of the backboard attachment device 41 is the other leaf of the hinge. The hinge chute knuckle 420 of the chute 42 is one knuckle of the hinge, and the hinge plate knuckle 410 of the backboard attachment device 41 is the other knuckle of the hinge. The hinge may be held together using the hinge pin 43.

The connecting chute 42 and the backboard attachment device 41 of the chute assembly 4 providing relative hinged or pivotal movement enables the movement of chute 42 with respect to the backboard attachment device 41 during installation, transport, or storage. In some embodiments, the movement of the chute 42 with respect to the backboard attachment device 41 is not unlimited. For example, the hinge chute knuckle 420 may include a stop 4200 that fixes the chute 42 at an angle with respect to the backboard attachment device 41 during a game.

Various angles may be selected for a game, for example, between 90 and 180 degrees. These angles allow the slide 421 to catch and then direct a ball in a direction of a game player when the chute assembly 4 is in use during a game. In other words, before a game, the chute 42 is moved with respect to the backboard attachment device 41 so that the stop 4200 of the hinge chute knuckle 420 contacts the plate 411 of the backboard attachment device 41, placing the chute assembly 4 in a fixed and stable position for ball return.

Figure 3:
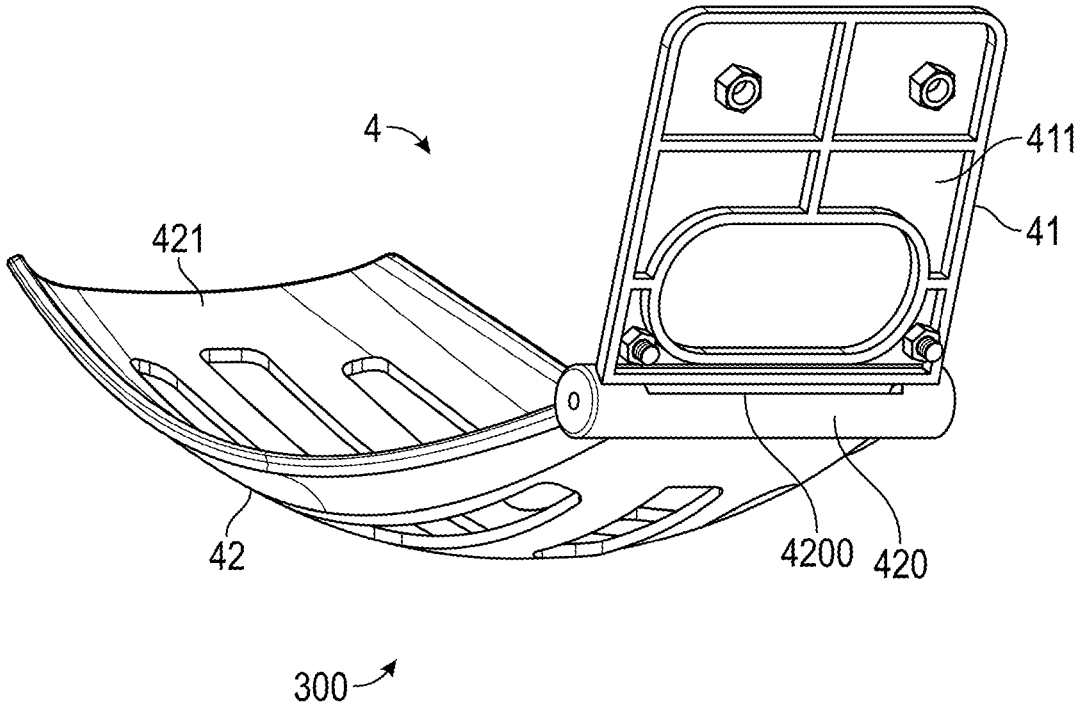
FIG. 3 is a perspective view of a back of the ball return chute assembly of FIG. 1 showing a back of a hinge chute knuckle connecting the chute to the backboard attachment device, in accordance with some embodiments.

FIG. 3 is a perspective view 300 of a back of the ball return chute assembly of FIG. 1 showing a back of the hinge chute knuckle connecting the chute to the backboard attachment device, in accordance with some embodiments. The chute assembly 4 may include the chute 42 and the backboard attachment device 41. The chute 42 may include the slide 421, the hinge chute knuckle 420, and the stop 4200. Thus, before a game, the chute 42 may be moved with respect to the backboard attachment device 41 so that the stop 4200 of the hinge chute knuckle 420 contacts the plate 411 of the backboard attachment device 41, placing the chute assembly 4 in a fixed and stable position for ball return.

Goal Assembly with Backboard Attached Ball Return Chute

Figure 4:
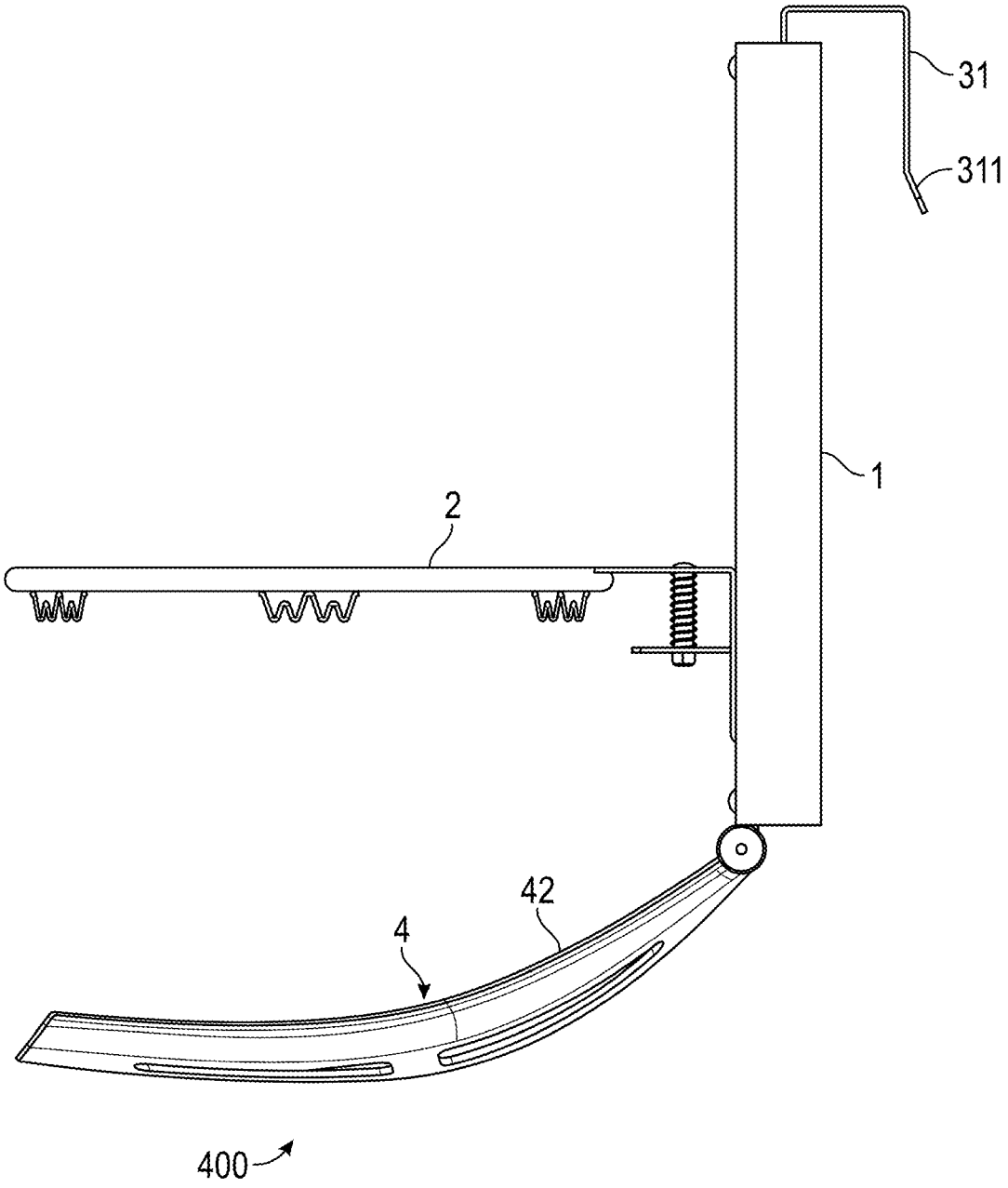
FIG. 4 is a side view of a left side of a basketball goal assembly that includes the ball return chute attached to a backboard, in accordance with some embodiments.

FIG. 4 is a side view 400 of a left side of a basketball goal assembly that includes a backboard attached ball return chute, in accordance with some embodiments. The goal assembly of FIG. 4 includes a backboard 1, a basket assembly 2, and a chute assembly 4. The chute assembly 4 may be physically attached to the backboard 1 using the backboard attachment device of the chute assembly 4. The backboard attachment device of the chute assembly 4 is not visible in FIG. 4 due to the side wall of backboard 1.

The basket assembly 2 may also be physically attached to the backboard 1. The basket assembly 2 includes, for example, a rim or hoop and an attachment plate for attaching to the backboard 1.

The chute assembly 4 is positioned directly beneath the basket assembly 2 so that the chute 42 of the chute assembly 4 receives a ball from the basket assembly 2. As best illustrated in FIG. 4, the chute 42 of the chute assembly 4 is shown in a position where it returns a ball during a game.

In some embodiments, the goal assembly of FIG. 4 is portable and further includes one or more door hooks or door hangers 31 for hanging the goal assembly over a door. Each of the door hangers 31 may be attached to the top of the backboard 1 and include a flange 311. The flange 311 may help guide each of the door hangers 31 over the top of a door. In some embodiments, the goal assembly includes at least two door hangers 31 for stability.

Figure 5:
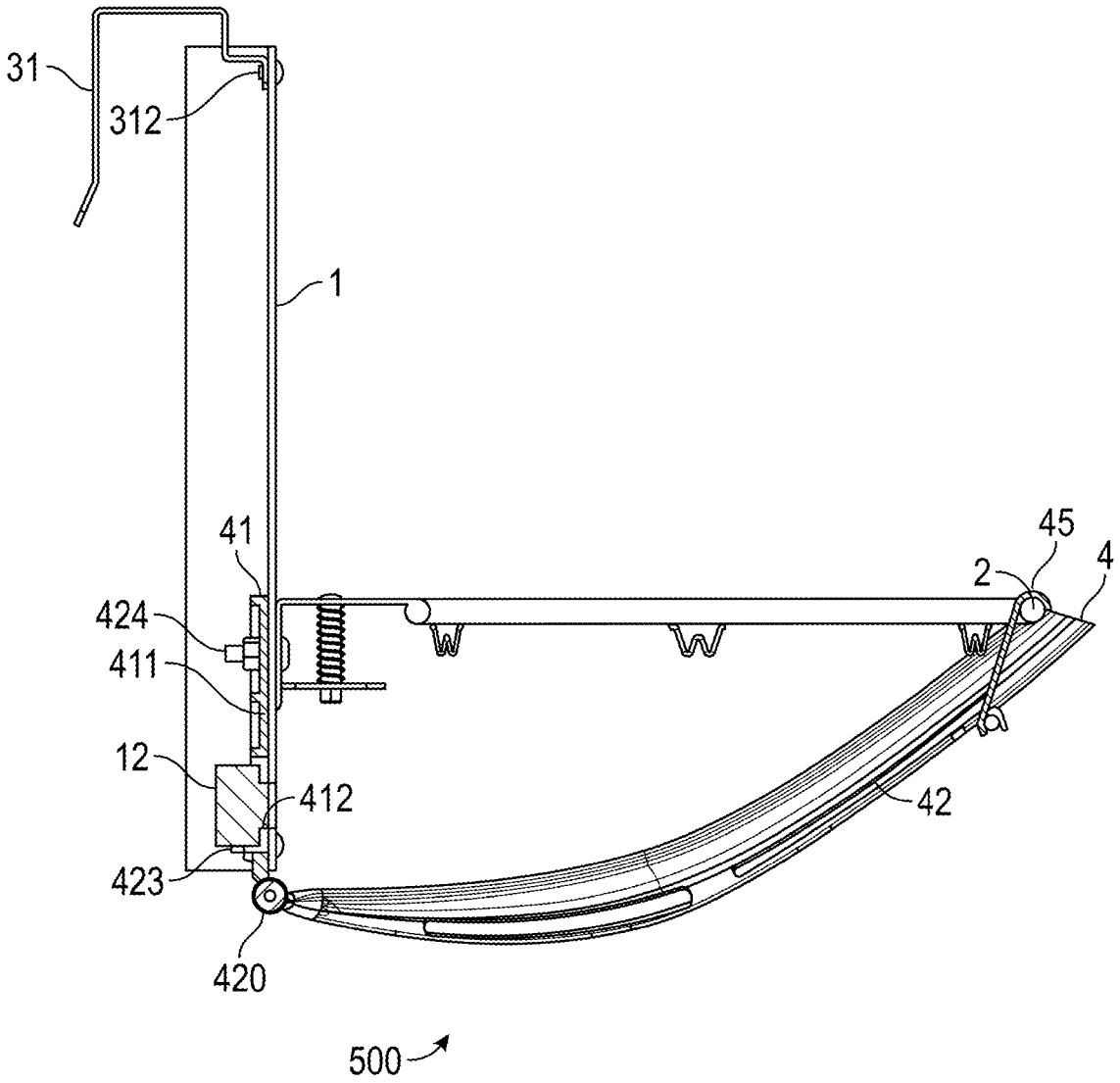
FIG. 5 is a cross-sectional view of a right side of the basketball goal assembly of FIG. 4, in accordance with some embodiments.

FIG. 5 is a cross-sectional view 500 of a right side of the basketball goal assembly of FIG. 4, in accordance with some embodiments. FIG. 5 more clearly shows how the chute assembly 4 may be attached to backboard 1. For example, in some embodiments, the plate 411 of the backboard attachment device 41 is attached to the back of the backboard 1 using at least one bolts 423 and 424. In some embodiments, the bolt 423 and/or 424 may be the same bolt that is used to secure basket assembly 2 to backboard 1.

FIG. 5 also shows the door hanger 31 secured to backboard 1. For example, in some embodiments, the door hanger 31 is secured to the back of the backboard 1 using a bolt 312.

As described above, in some embodiments, the backboard attachment device 41 can include an opening or window 412. The window 412 is used to enable a sensor 12 to be inserted through or see through backboard attachment device 41 and count the number of balls received by chute 42. Note that backboard 1 also includes a hole or window for sensor 12. The sensor 12 may further including a user interface that displays the count and/or wirelessly transmits the count to an electronic device such as a portable electronic device.

In some embodiments, the chute assembly 4 further includes a rim hook 45. As shown in FIG. 5, the backboard attachment device 41 attaches one end of the chute assembly 4 to the backboard 1. The rim hook 45 may therefore be used to attach the other end of the chute assembly 4 to the basket assembly 2 when the goal assembly is being installed, transported, stored, or when the goal assembly is not being used. In other words, any time the goal assembly is not being used for a game, the rim hook 45 can be used to temporarily secure the chute 42 of the chute assembly 4 to the basket assembly 2. The chute 42 is moved with respect to backboard attachment device 41 using a hinge mechanism such as that which includes the hinge chute knuckle 420. In FIG. 5, the chute 42 is shown in a stowed position with respect to the backboard attachment device 41 that is used when the goal assembly is not being used or a game is not being played.

Figure 6:
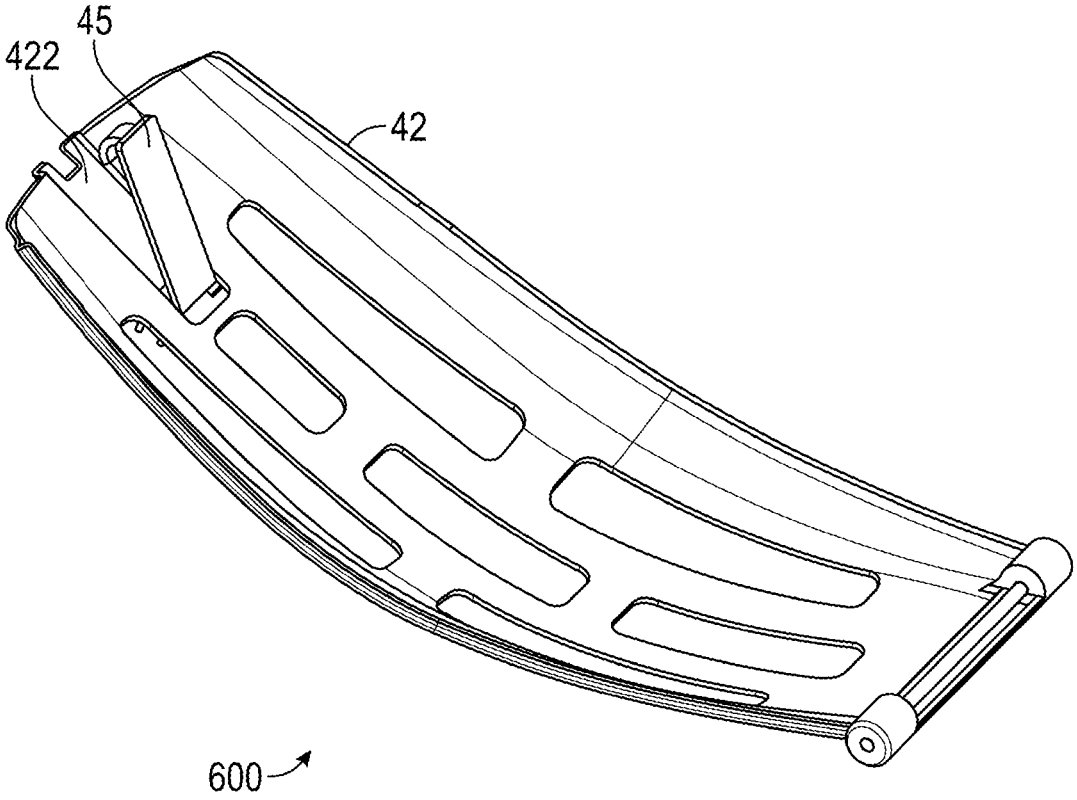
FIG. 6 is a perspective view of a top of the chute of FIG. 5 showing a rim hook deployed, in accordance with some embodiments.

FIG. 6 is a perspective view 600 of a top of the chute of FIG. 5 showing the rim hook deployed, in accordance with some embodiments. FIG. 6 shows that the rim hook 45 of the chute 42 may be deployed from a slot 422 in the chute 42 and otherwise stored in the slot 422 when not in use. For example, during a game the rim hook 45 is placed in the slot 422 to prevent any interference with the ball return trajectory facilitated by the chute 42.

Figure 7:
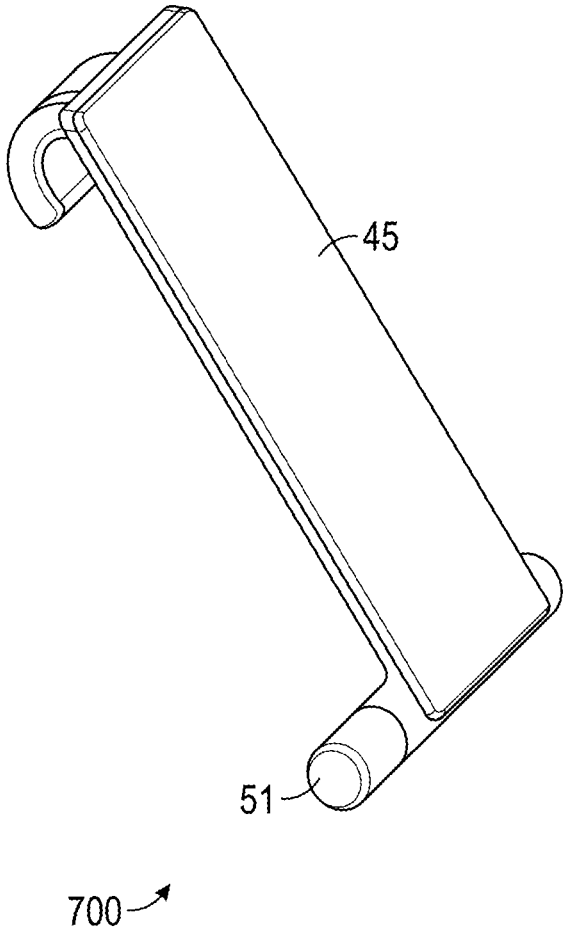
FIG. 7 is a perspective view of a top of the detached rim hook of FIG. 6, in accordance with some embodiments.

FIG. 7 is a perspective view 700 of a top of the detached rim hook of FIG. 6, in accordance with some embodiments. FIG. 7 shows that rim hook 45 includes peg 51 for pivotally connecting to the chute 42.

Figure 8:
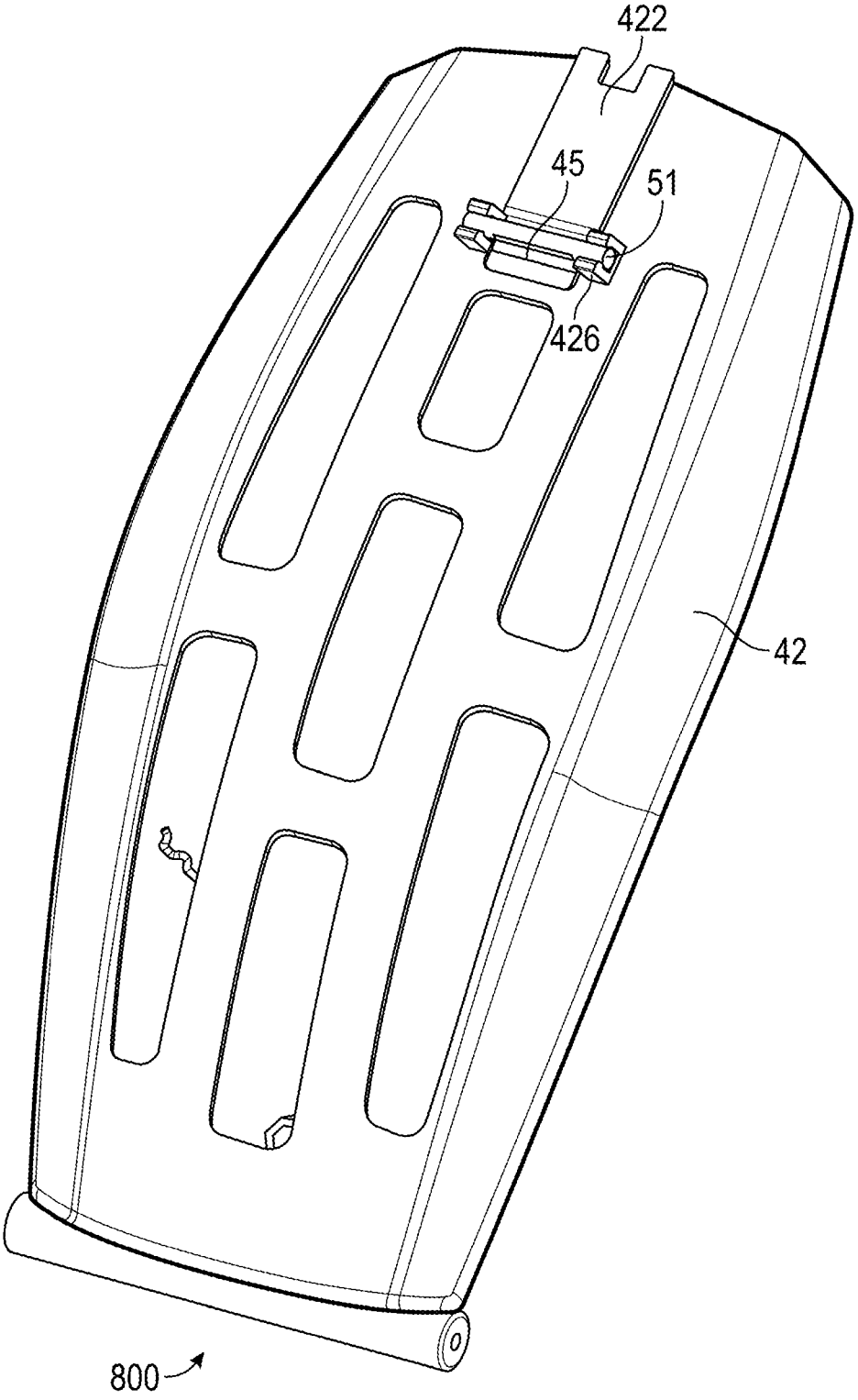
FIG. 8 is a perspective view of a bottom of the ball return chute of FIG. 6 showing how the rim hook is connected to the ball return chute, in accordance with some embodiments.

FIG. 8 a perspective view 800 of a bottom of the chute of FIG. 6 showing how the rim hook 45 is connected to the chute, in accordance with some embodiments. FIG. 8 shows that peg 51 of rim hook 45 is inserted into a clip 426 on the bottom of the chute 42 in order to connect the rim hook 45 to the chute 42. FIG. 8 also illustrates the bottom or backside of the slot 422. The frontside of slot 422 may thus be used to store the rim hook 45 during a game. The connection of the rim hook 45 to the chute 42 using the peg 51 and the clip 426 allows the rim hook 45 to easily be moved from a deployed position outside of slot 422 to a stored position within the slot 422.

Goal Assembly with Two Basket Assemblies and Ball Return Chutes

Figure 9:
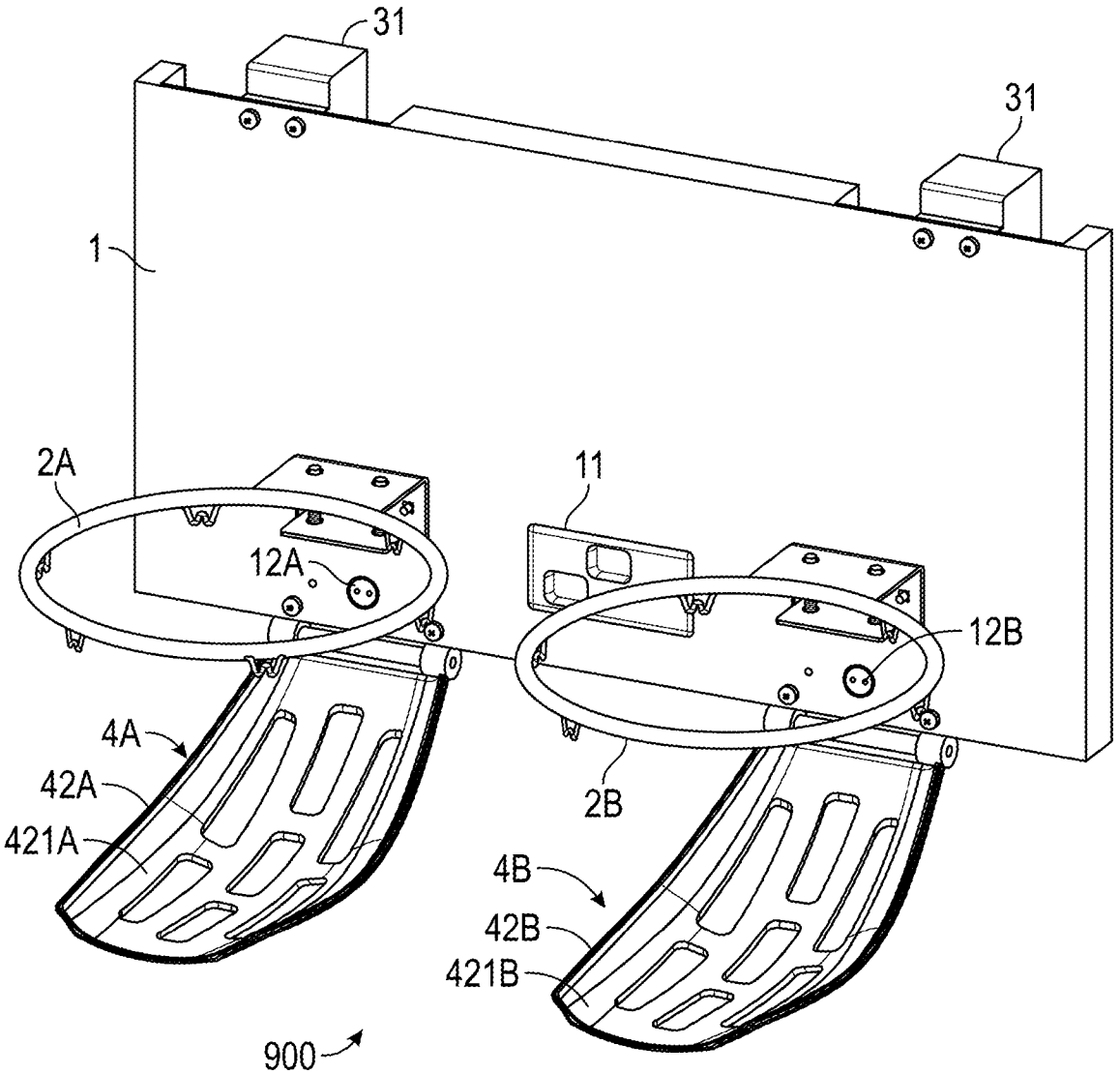
FIG. 9 is a perspective view of a front of a portable goal assembly for hanging over a door, in accordance with some embodiments.

FIG. 9 is a perspective view 900 of a front of a portable goal assembly for hanging over a door, in accordance with some embodiments. The portable goal assembly of FIG. 9 includes a backboard 1, at least one door hanger 31 (e.g., a pair of door hangers 31), two side-by-side basket assemblies 2A and 2B, and two ball return chute assemblies 4A and 4B. The chute assemblies 4A and 4B may be physically attached to the backboard 1 using a backboard attachment device (not visible). The chute assemblies 4A and 4B can, in some embodiments, include any of the features of the chute assemblies described in reference to the other embodiments of the disclosure.

The basket assemblies 2A and 2B may also physically attached to the backboard 1. The chute assembly 4A is positioned directly beneath the basket assembly 2A so that the slide 421A of the chute 42A receives a ball from the basket assembly 2A. The slide 421A may then return the ball to a game player in a direction, for example, perpendicular to the backboard 1. Similarly, the chute assembly 4B may be positioned directly beneath the basket assembly 2B so that the slide 421B of the chute 42B receives a ball from basket assembly 2B. The slide 421B may then return the ball to a game player in a direction, for example, perpendicular to backboard 1.

The door hangers 31 may be attached to a top of the backboard 1 and allow the goal assembly to be attached to a door for a game. The door hangers 31 may be placed over the top of a door and may be configured to permit the door to close after attachment.

The backboard attachment devices of the chute assemblies 4A and 4B may each include a hole or window allowing one or more sensors 12A and 12B to sense balls received from the basket assemblies 2A and 2B. In some embodiments, the backboard 1 also includes holes or windows for the sensors 12A and 12B.

In some embodiments, the backboard 1 also includes one or more holes or windows 11 for a scoreboard. The scoreboard is, for example, in communication with the sensors 12A and 12B to tally or count a score for each of the basket assemblies 2A and 2B. The windows may be configured as digital displays and may display, for example, a digital reading of a score for each of the basket assemblies 2A and 2B separately and also a time (e.g., a countdown). Therefore, in some embodiments, there may be three windows, a first window for displaying the score of the basket assembly 2A, a second window for displaying the score of the basket assembly 2B, and a third window for displaying a time.

Figure 10:
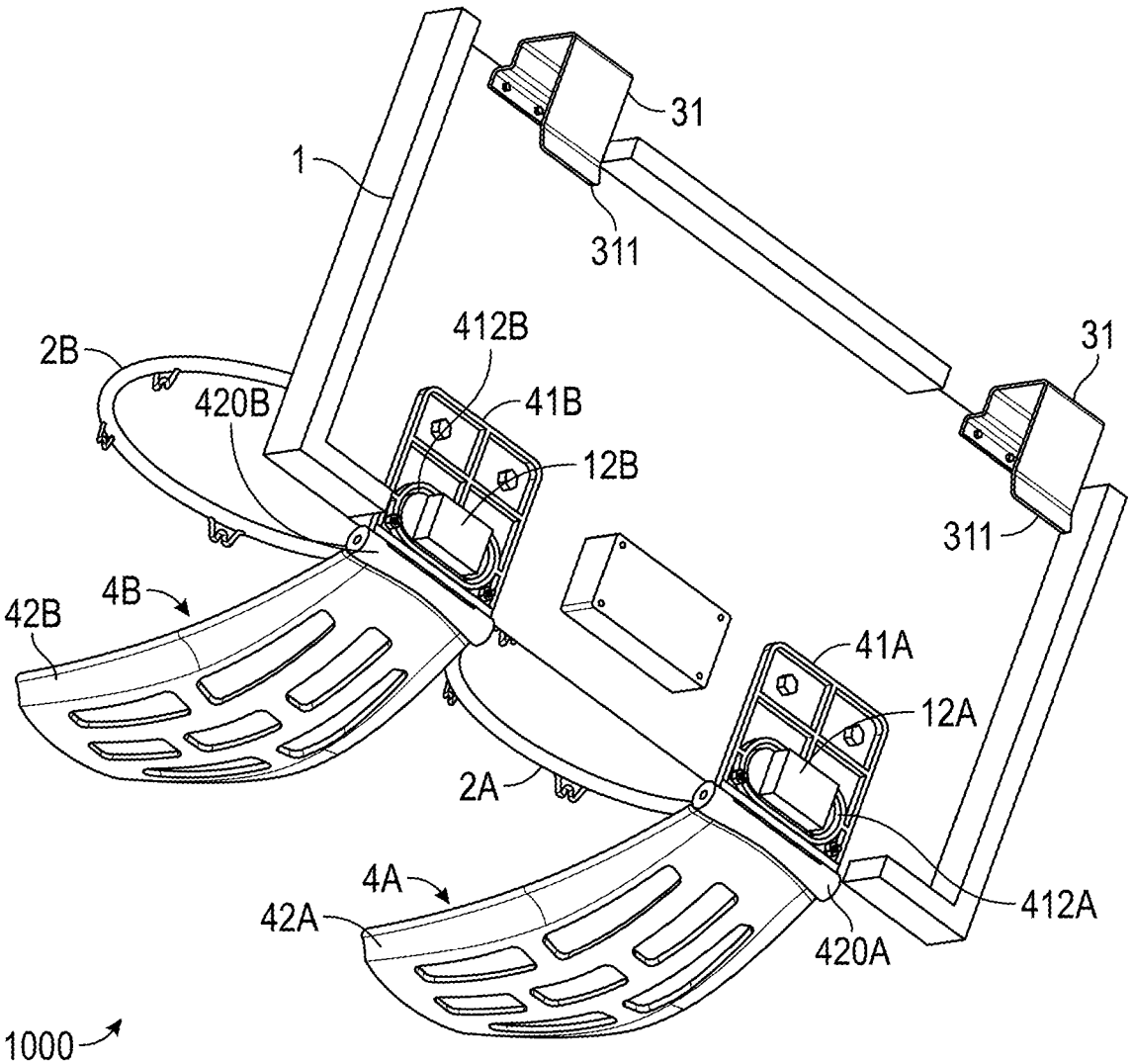
FIG. 10 is a perspective view of a back of the portable goal assembly of FIG. 9, in accordance with some embodiments.

FIG. 10 is a perspective view 1000 of the back of the portable goal assembly of FIG. 9, in accordance with some embodiments. FIG. 10 shows that the backboard attachment device 41A of the chute assembly 4A and the backboard attachment device 41B of the chute assembly 4B are attached to the back of the backboard 1. FIG. 10 also shows that door hangers 31 are attached to the back of backboard 1. The flanges 311 of the door hangers 31 may be used to the guide door hangers 31 over the top of a door.

In some embodiments, the backboard attachment devices 41A and 41B include windows 412A and 412B, respectively. The windows 412A and 412B may each receive one or more sensors 12A and 12B or, alternatively, allow the sensors 12A and 12B to be spaced from and detect through the backboard attachment devices 41A and 41B.

In some embodiments, the backboard attachment device 41A and the chute 42A of the chute assembly 4A may be connected by a hinge mechanism created using a hinge chute knuckle 420A. Similarly, the backboard attachment device 41B and the chute 42B of the chute assembly 4B may be connected by a hinge mechanism created using hinge a chute knuckle 420B.

While the present teachings are described in conjunction with some embodiments, it is not intended that the present teachings be limited to such embodiments. On the contrary, the present teachings encompass various alternatives, modifications, and equivalents, as will be appreciated by those of skill in the art.

Further, in describing some embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the some embodiments.

What is claimed is:

1. A basketball goal assembly, comprising:

a backboard;

a basket assembly attached to the backboard;

a basketball return chute assembly that includes a chute adapted to receive a ball from the basket assembly and direct and release the received ball from the chute, and the basketball return chute assembly further includes a backboard attachment device connected to the chute via a hinge and adapted to attach to the backboard, to place the chute beneath the basket assembly, and to cause the chute to direct the received ball in a direction away from the backboard;

the chute comprises a slide and the backboard attachment device comprises a plate; and a rim hook is connected to the slide for coupling a distal end of the slide to a rim of the basket assembly to stow the chute when not in use.

2. The basketball goal assembly of claim 1, wherein the hinge further comprises a hinge pin, wherein the slide comprises a hinge chute knuckle at one end, wherein the plate comprises a hinge plate knuckle at one end, and wherein the backboard attachment device is connected to the chute by axially aligning the hinge chute knuckle and the hinge plate knuckle and inserting the hinge pin through the hinge chute knuckle and the hinge plate knuckle while they are aligned.

3. The basketball goal assembly of claim 2, wherein the hinge chute knuckle further includes a stop that fixes the position of the chute with respect to the backboard attachment device when the plate contacts the stop.

4. The basketball goal assembly of claim 1, further comprising one or more door hangers attached to the backboard for hanging the basketball goal assembly over a door.

5. The basketball goal assembly of claim 4, wherein each door hanger of the one or more door hangers includes a flange at one end of the each door hanger to guide the door hanger over the door.

6. The basketball goal assembly of claim 1, wherein the slide further includes a clip, the rim hook includes a peg at one end, and the peg is inserted into the clip to connect the rim hook to the slide.

7. The basketball goal assembly of claim 6, wherein the slide further includes a slot for accepting the rim hook when not in use and preventing the rim hook from interfering with a ball being returned by the slide.

8. A portable two basket basketball goal assembly, comprising:

a backboard;

one or more door hangers attached to the backboard for hanging the basketball goal assembly over a door;

two basket assemblies attached side-by-side to the backboard;

each of the two basket assemblies comprises a basketball return chute assembly, each basketball return chute assembly includes a chute adapted to receive a ball from an associated basket assembly of the two basket assemblies and direct the received ball, each basketball return chute assembly includes a backboard attachment device connected to a respective chute adapted to attach to the backboard, to place the respective chute beneath the associated basket assembly, and to cause the respective chute to direct the received ball in a direction away from the backboard;

each of the chutes comprises a slide and each of the backboard attachment devices comprises a plate; and each of the chute assemblies further comprises a hinge pin, each slide comprises a hinge chute knuckle at one end, a respective plate comprises a hinge plate knuckle at one end, and each backboard attachment device is connected to a respective chute by axially aligning the respective hinge chute knuckle and the respective hinge plate knuckle and inserting the respective hinge pin through the respective hinge chute knuckle and the respective hinge plate knuckle while they are aligned.

9. The portable two basket basketball goal assembly of claim 8, wherein the hinge chute knuckle further includes a stop that fixes the position of the chute with respect to the backboard attachment device when the plate contacts the stop.

* * * * *